US005513473A

United States Patent [19]

Sucre F.

[11] Patent Number: 5,513,473

[45] Date of Patent: May 7, 1996

[54] PREFABRICATED BUILDING SYSTEM

[76] Inventor: Alfredo Sucre F., Calle Altagracia, Res. Las Tabaqueras, Torre 2, Apt. 1-A, Sector Sorocaima, La Trinidad, Caracas, Venezuela

[21] Appl. No.: 132,095

[22] Filed: Oct. 5, 1993

[30] Foreign Application Priority Data

Oct. 6, 1992 [VE] Venezuela ..... 001562

[51] Int. Cl.[6] ..... E04C 2/08

[52] U.S. Cl. ..... 52/272; 52/588.1; 52/580; 52/281

[58] Field of Search ..... 52/271, 272 OR, 52/277, 578, 281, 588.1, 479, 282.2, 282.3, 271, 270, 284, 580

[56] References Cited

U.S. PATENT DOCUMENTS

| | | | |
|---|---|---|---|
| 2,809,404 | 10/1957 | Hinds | 52/282.3 |
| 3,327,440 | 6/1967 | Watkins | 52/282.2 |
| 3,736,035 | 5/1973 | Brown et al. | 52/282.3 |
| 3,738,083 | 6/1973 | Shimano | 52/271 |
| 3,768,222 | 10/1973 | Birum, Jr. | 52/282.2 |
| 3,774,362 | 11/1973 | Matuschek et al. | 52/284 |
| 3,820,299 | 6/1974 | Verholt | 52/282.2 |
| 4,104,837 | 8/1978 | Naito | 52/588.1 |
| 4,186,539 | 2/1980 | Harmon et al. | 52/580 |
| 4,493,172 | 1/1985 | Jones | 52/282.3 |
| 5,009,042 | 4/1991 | Sacco et al. | 52/282.2 |
| 5,097,643 | 3/1992 | Wittler | 52/281 |
| 5,105,594 | 4/1992 | Kirchner | 52/282.3 |
| 5,261,205 | 11/1993 | Sandor | 52/284 |
| 5,271,687 | 12/1993 | Holka et al. | 52/281 |
| 5,313,751 | 5/1994 | Wittler | 52/588.1 |

FOREIGN PATENT DOCUMENTS

| | | |
|---|---|---|
| 0051319 | 5/1982 | European Pat. Off. . |
| 0089443 | 9/1983 | European Pat. Off. . |
| 0121031 | 10/1984 | European Pat. Off. . |
| 0188583 | 7/1986 | European Pat. Off. . |
| 0193571 | 9/1986 | European Pat. Off. . |
| 0210116 | 1/1987 | European Pat. Off. . |
| 0235033 | 9/1987 | European Pat. Off. . |
| 337032 | 1/1968 | Spain . |
| 335441 | 2/1968 | Spain . |
| 333078 | 3/1968 | Spain . |
| 360591 | 11/1968 | Spain . |
| 351465 | 12/1969 | Spain . |
| 411974 | 1/1976 | Spain . |

(List continued on next page.)

OTHER PUBLICATIONS

R–Control Panel Building System—from 1991 Sweet's Homebuilding/Remodeling Catalog File, McGraw Hill.

Steelox Hardwall Building System, TW–100 Wall Panel, and Design–Line Wall Panel System—brochure sent to applicant on Jul. 27, 1993.

Panelized Brick Wall System for Architectural Applications by Bonitz Mfg./US Brick., Inc.—brochure sent by US Brick/Real Brick to applicant on Aug. 21, 1990.

*Primary Examiner*—Wynn E. Wood

*Attorney, Agent, or Firm*—Fish & Neave; Brenda J. Panichi; Edward Etkin

[57] ABSTRACT

A prefabricated building system having a variety of structural bearing panels/frames shaped and designed for direct interconnection with one another. Each panel has an upper stud and a lower stud joined by at least one vertical stud. Only one vertical stud is used if the panel is to be joined, along the vertical edge that lacks a vertical stud, to another panel. The vertical edge having a vertical stud may or may not be interconnected to another panel. If the vertical stud is to be joined to the vertical stud of another panel, that stud must be designed for direct connection with that other panel.

One such vertical stud is "⊔" shaped, carrying male connection elements for interconnection along the edge of a panel that does not have a vertical stud. Another such vertical stud is "V" shaped, and typically is used for perpendicular connection with a similarly shaped stud along the converging sides, i.e., the faces of the "V" portion. The panels have empty space left between the studs to allow for later insertion of insulation material or other construction materials, if desired.

64 Claims, 13 Drawing Sheets

FOREIGN PATENT DOCUMENTS

| | | |
|---|---|---|
| 429404 | 1/1977 | Spain . |
| 435057 | 1/1977 | Spain . |
| 243836 | 11/1979 | Spain . |
| 487268 | 3/1981 | Spain . |
| 497850 | 5/1982 | Spain . |
| 506457 | 9/1982 | Spain . |
| 537352 | 6/1986 | Spain . |
| 9101239 | 12/1991 | Spain . |
| 83-1775 | of 1983 | Venezuela . |
| 89-0790 | 5/1989 | Venezuela . |
| 90-1657 | 10/1990 | Venezuela . |

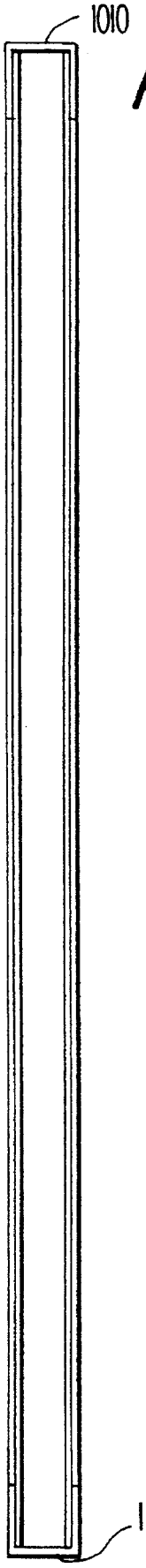
FIG.12
FIG.13
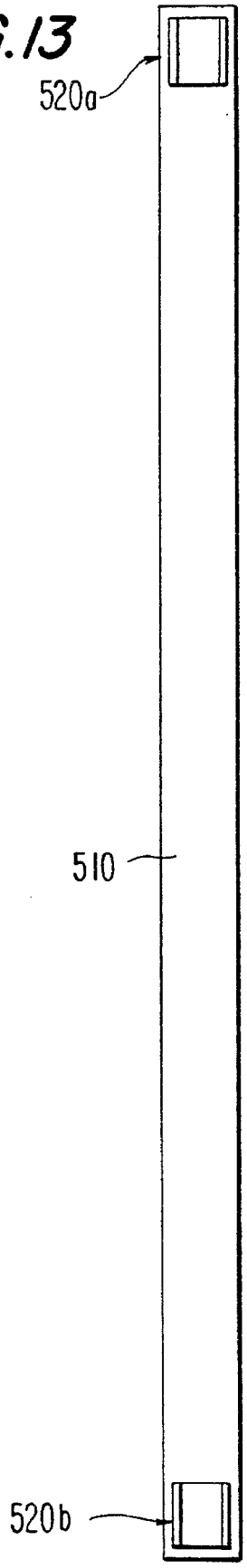

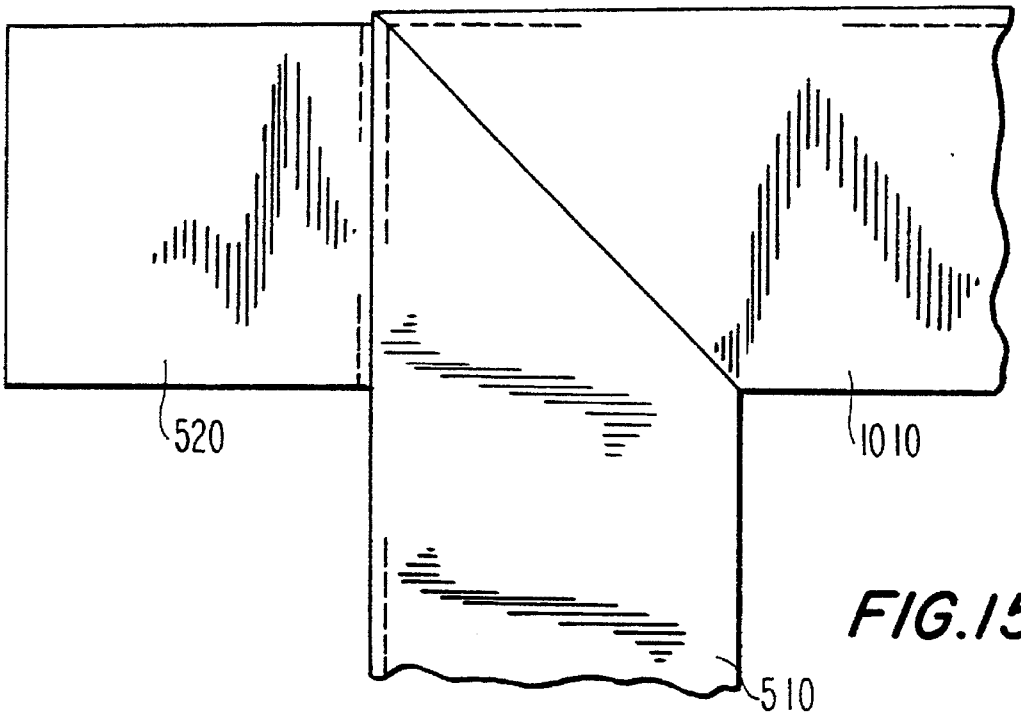
FIG.15
FIG.16
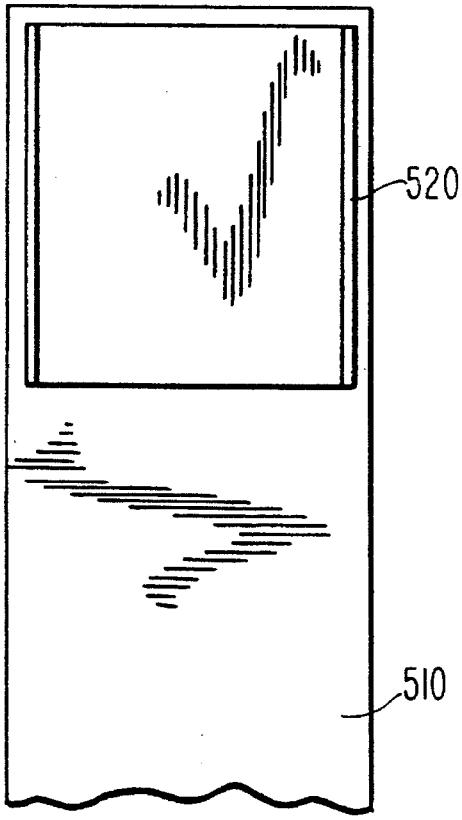
FIG.14
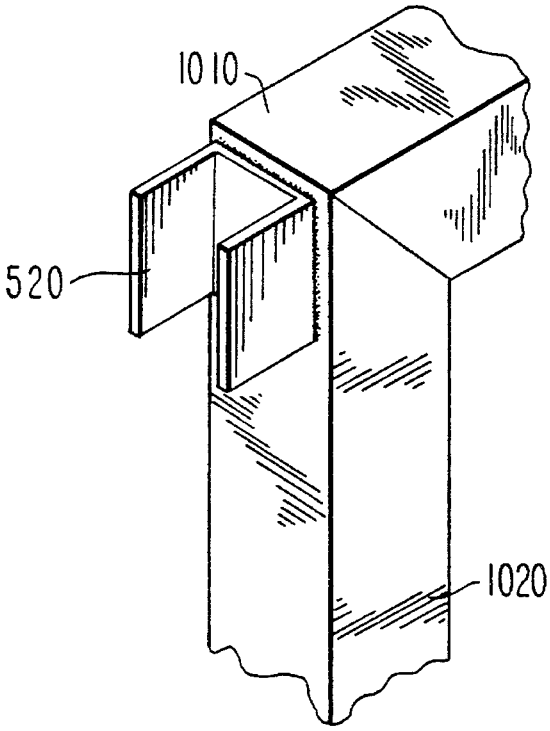

PREFABRICATED BUILDING SYSTEM

BACKGROUND OF THE INVENTION

The present invention relates to a prefabricated building system having lightweight panels which may be directly interconnected. More particularly, the invention relates to panels formed from generally parallel upper and lower studs and at least one vertical stud, forming or leaving a central cavity in the panel. The panels are configured to be directly interconnected along their vertical edges with their axes aligned.

Over the years, the construction industry has attempted to provide simple construction systems which enable the building of stable and aesthetic habitable structures while also allowing the possibility of freedom of design, offering an unlimited choice of selections of exterior and interior finishing, and permitting adaptation of thermal and acoustic insulation (when included) to meet any climate condition or situation. At the same time, such systems must be economically accessible to the public, while using the minimum amount of construction materials and labor and the shortest possible construction time as technically possible.

Prefabricated construction systems have been studied and designed in order to achieve the above described construction system requirements. One type of prefabricated construction system known in the art utilizes basic elements or panels joined together to erect the desired edifice. However, most of these systems do not satisfy all of the above-described specifications.

One such prefabricated construction system having basic elements utilizes sandwich-type panels formed by two solid panels of stranded lumber facings with a solid expanded polystyrene ("EPS") insulation core in between. These panels are generally rectangular and have projections of the lumber facings along one vertical edge and recesses along the other vertical edge. Interconnection of the panels is achieved by fitting the projections of one panel into the recesses of another panel. These panels fit on standard lumber sill plates which are set in place on the floor or foundation of the building.

This type of prefabricated panel has several disadvantages. First, because direct connections between vertical edges cannot be established at wall intersections and at corners, the central alignment planes of the panels (the vertical plane cutting across the center of the panel from the middle of one vertical edge to the middle of the opposite vertical edge) will not meet where the panels intersect. Accordingly, a complete and regular alignment of the central alignment planes of the panels cannot be maintained throughout the structure and the geometric order of the structure cannot be preserved. Nor can the design be easily adapted to atypical building forms, spaces, and arrangements which may be produced with architectural freedom of design. Sometimes other construction methods and materials must therefore be used within the same structure, thus losing uniformity and homogeneity.

Additionally, because the panels are substantially solid, they do not offer an internal air cavity for the free placement of pipes or tubes, or electrical, mechanical, or plumbing installations. Such internal space would be useful during the assembly of the system. Moreover, the solid construction makes such panels rather heavy, requiring more than one person for their handling and installation, thereby increasing construction time and cost.

Finally, the structure of these panels requires specific facing and insulation materials or products. There is no opportunity for creating an internal air cavity needed for such uses as described above. Furthermore, the user does not have the opportunity to select the desired ideal thermal and/or acoustic insulation materials, if required, for the specific construction area or climate condition.

Another common construction system consists of prefabricated concrete elements or panels, having internal welded metal mesh, which receive and transmit loads directly from the ceiling to the foundation base. These panels are rectangular and have a recess in one face formed by an inward mold approximately 1¼ inches deep. Along the vertical edges of the panels, the panels have "⋀" shaped cuts, i.e., V-shaped cuts which do not extend to the corners formed by the panel faces and vertical edges, with the vertex of the cuts facing the panels. When the panels are aligned along their vertical edges, the "⋀" shaped cuts form a substantially closed cavity between the panels. The connection of these panels is effected by inserting a metal plate in this cavity and subsequently pouring cement in the remaining space within the cavity.

This type of prefabricated panel also has several disadvantages. First, these panels limit construction to one story structures because of the specific design of the panels. Also, the task of joining the panels involves the preparation and pouring of cement, the placement of metal plates, etc., and accordingly is rather time consuming and requires constant attention. Because a substantially closed cavity in which cement can be poured is required, a"⋀" shaped cut of one panel must be placed along a face (as opposed to a vertical edge) of the adjoining panel to form a corner, thereby destroying alignment and meeting of the central alignment planes of those panels at the vertical edges. Finally, pipes or tubes, and electrical, mechanical, and plumbing installations are generally located within the molded cavity sides of two panels with their cavities facing one another. This placement doubles the number of panels required, thereby increasing construction costs and the amount of construction space required.

It therefore would be desirable to provide a prefabricated building system which is simple to use, having structural panels which are readily aligned and interconnected, even in atypical structures. The system should allow direct interconnection of panels, so that additional construction elements are not required, thereby reducing construction costs and time. Alignment of the central alignment planes of all of the panels should be maintained throughout the structure.

It would also be desirable to provide a prefabricated building system having lightweight, easily manipulated structural panels, which can be used to construct multi-story buildings.

It would further be desirable to provide a prefabricated building system which is simple to use and allows flexibility of construction materials, including flexibility of thermal and/or acoustic insulation materials used in order to adapt to different climate conditions and other situations. Internal space in which such structural equipment as pipes or tubes, and electrical, mechanical, or plumbing installations may be located should also be provided.

SUMMARY OF THE INVENTION

It therefore is an object of this invention to provide a prefabricated building system having easily interconnected structural panels which allow for direct intersection of the vertical edges and alignment of central alignment planes to provide geometric order throughout the structure. The interconnection should accommodate any atypical or irregular shape required.

It is a further object of this invention to provide a prefabricated building system having lightweight, yet sturdy, structural panels which may be used to construct multi-story buildings. The panels should be easily handled and installed by a single person, without the need for additional construction means.

It is another object of this invention to provide a prefabricated building system allowing total freedom of choice in the selection of the exterior and interior finishings, the thermal and/or acoustic insulation materials (if and when called for), and mechanical, electrical, or plumbing installations as controlled by client taste, climate conditions, client budget, etc.

These and other objects of the invention are accomplished in accordance with the principles of this invention by providing a prefabricated building system having an upper stud, a lower stud, and at least one vertical stud (joining juxtaposed ends of the upper and lower studs), forming a "⊏" shaped frame for the panel. The number of vertical studs (i.e., one or two) depends on the location and function of the particular panel. The vertical studs are designed to directly engage at least one of the studs of another structural panel. The upper and lower studs are generally horizontal and typically have a "⊔" shaped cross-section. The vertical studs may either have a "⊔" shaped cross-section or a "V" shaped cross-section.

The "⊔" shaped vertical stud may be used along a free edge of a panel to thereby form a finishing or terminal panel. Alternatively, a "⊔" shaped vertical stud may be used for interconnection with another panel. In that case, the "⊔" shaped vertical stud includes at least one "male" connection element necessary to achieve interconnection with another panel. Typically two male connection elements are used, one located adjacent the top of the vertical stud and the other located adjacent the bottom of the vertical stud, each slightly narrower than the interior width of the "⊔" shaped upper and lower studs. The male connection elements therefore can form a tight fit inside the upper and lower studs of an adjacent panel to join the two panels. Thus, a continuous and consecutive alignment of panels is effected to construct straight walls of a building.

Corners and intersections of walls are formed by coupling and fixing together the angled faces of vertical studs with "V" shaped cross sections. Thus, the vertical edges of the panels may be directly joined, so that the central alignment planes meet where the vertical edges of the panels meet, thereby maintaining geometric order throughout the structure.

The interconnected panels create a regular structural skeleton that uniformly distributes and transmits all loads and forces. The panels are preferably hollow, and therefore may be handled, transported, and installed easily by a single person.

BRIEF DESCRIPTION OF THE DRAWINGS

The above and other objects and advantages of the invention, its nature, and various advantages will be apparent from the following detailed description of the preferred embodiments, taken in conjunction with the accompanying drawings, in which like reference characters represent like elements throughout, and in which:

FIG. 12 is a rear elevational view along line 12—12 of the panel of FIG. 11;

FIG. 13 is a front elevational view along line 13—13 of the panel of FIG. 11;

FIG. 14 is an enlarged isometric view of a male connection element shown in FIG. 10;

FIG. 15 is an enlarged view of the male connection element shown in FIG. 14, from the plan view perspective of FIG. 11;

FIG. 16 is an enlarged view of the male connection element shown in FIG. 14, from the front elevational view perspective of FIG. 13;

DETAILED DESCRIPTION OF THE INVENTION

Figure 1:
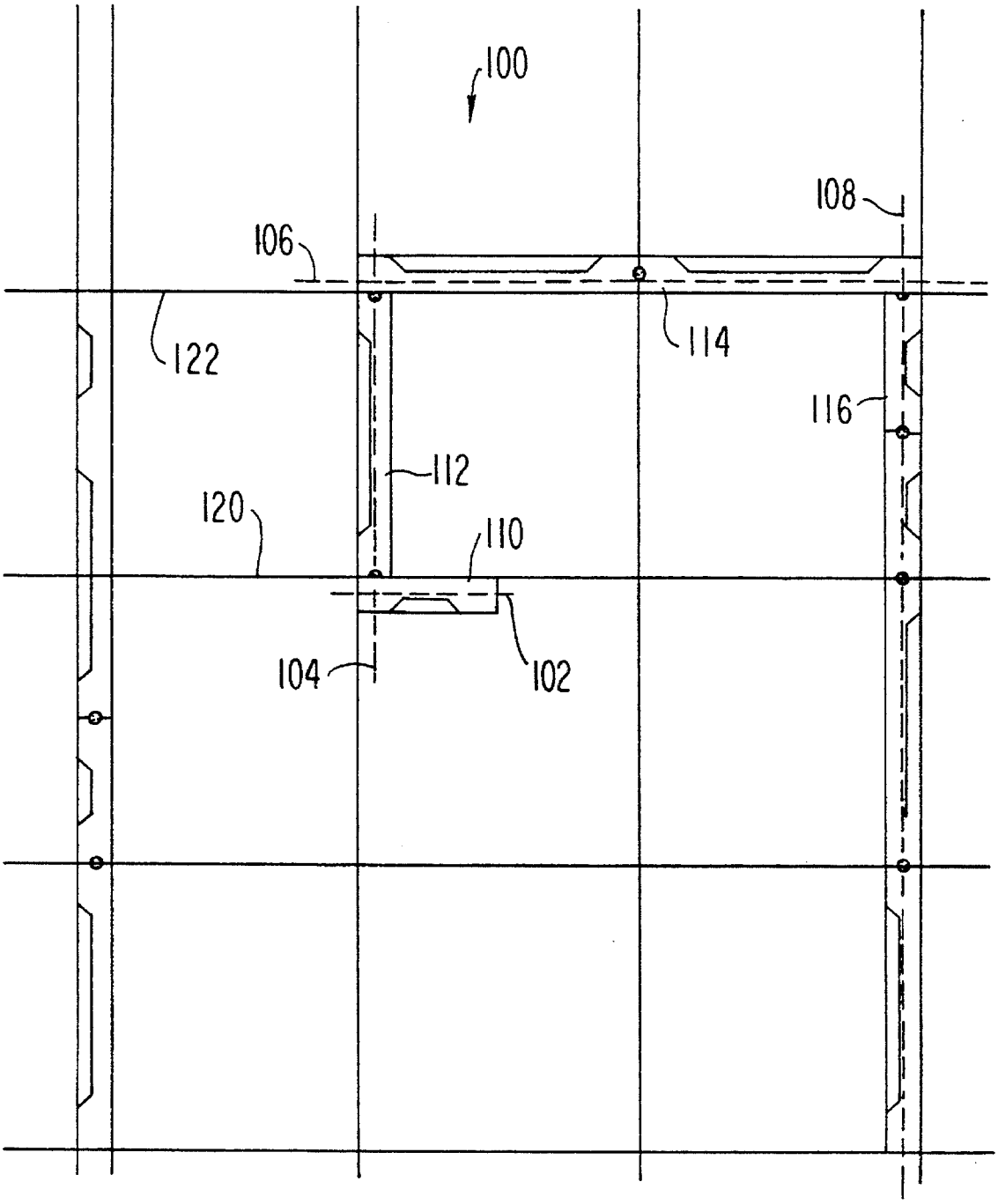
FIG. 1 PRIOR ART
FIG. 1 is a schematic plan view, in cross section, of connections between prior art panels.

A common previously known prefabricated construction system 100 using concrete panels, such as described above, is shown in FIGS. 1–3. As can be seen in FIG. 1, central alignment planes 102, 104, 106, and 108 do not always meet where panels 110, 112, 114, and 116 meet. Instead, the ends of panel 112 along central alignment plane 104 are displaced to the right of the ends of panels 110 and 114 so that central alignment planes 102, 104, and 106 intersect beyond the point of intersection of the vertical edges of panels 110, 112, and 114. Similarly, the free ends of panels 114 and 116 do not meet along their respective central alignment planes 106 and 108. Planes 102, 104, 106, and 108 accordingly are not considered to be properly aligned in the arrangement of construction system 100 shown in FIG. 1. As a result, the geometric order of the structure is not maintained, as can be seen upon comparison of the location of panel 110 below grid line 120 and panel 114 above grid line 122 (geometric order within the structure would require both panels to be on the same side of their respective grid line, i.e., either both above or both below).

Figure 2:
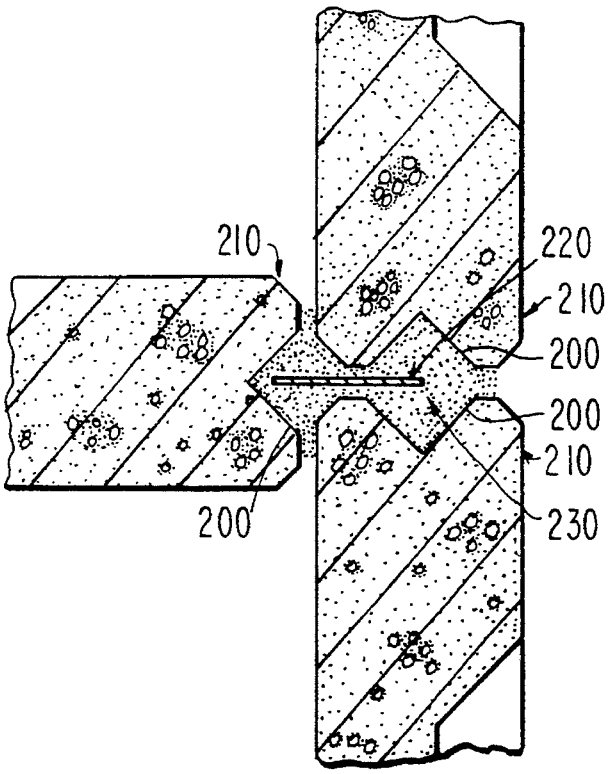
FIG. 2 PRIOR ART
FIG. 2 is a cross-sectional view of a three panel "⊢" shaped intersection formed with panels of the prior art.
Figure 3:
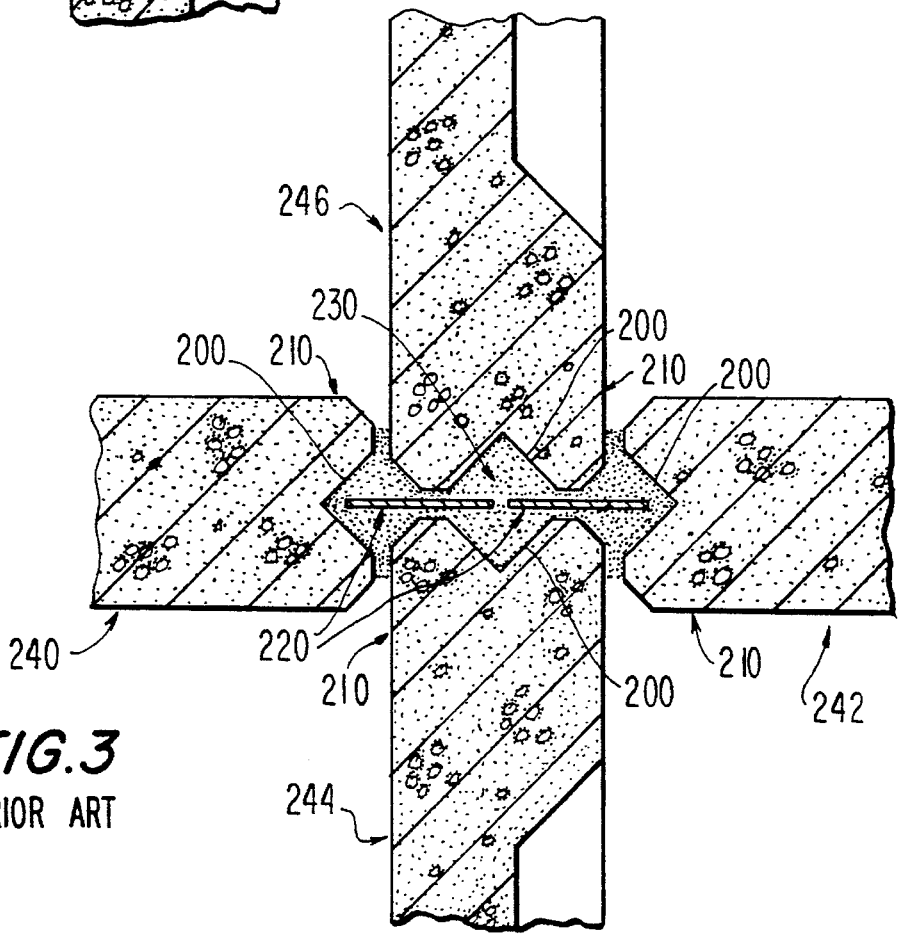
FIG. 3 PRIOR ART
FIG. 3 is a cross-sectional view of a four panel "+" shaped intersection formed with panels of the prior art.

AS shown in FIGS. 2 and 3, the vertical edges of the panels of system 100 have "⋀" shaped cut out portions 200. The concrete panels of system 100 are joined by placing together the "⋀" shaped cut out portions 200 of the panels to be joined, inserting expanded metal plates 220 (or dowels, or the like) in the spaces formed by cut out portions 200, and pouring cement or mortar 230 into the spaces. For the "⊢" shaped intersection of three panels shown in FIG. 2, only one metal plate 220 is necessary. However, for the "⊢" shaped intersection of four panels shown in FIG. 3, typically at least two metal plates 220 are necessary to bridge the distance between aligned panels 240, 242 positioned on either side of aligned panels 244, 246. The method required to join the panels in FIGS. 1–3 clearly is time consuming, requiring prior preparation of the connecting materials, and precise insertion of the materials.

Figure 4:
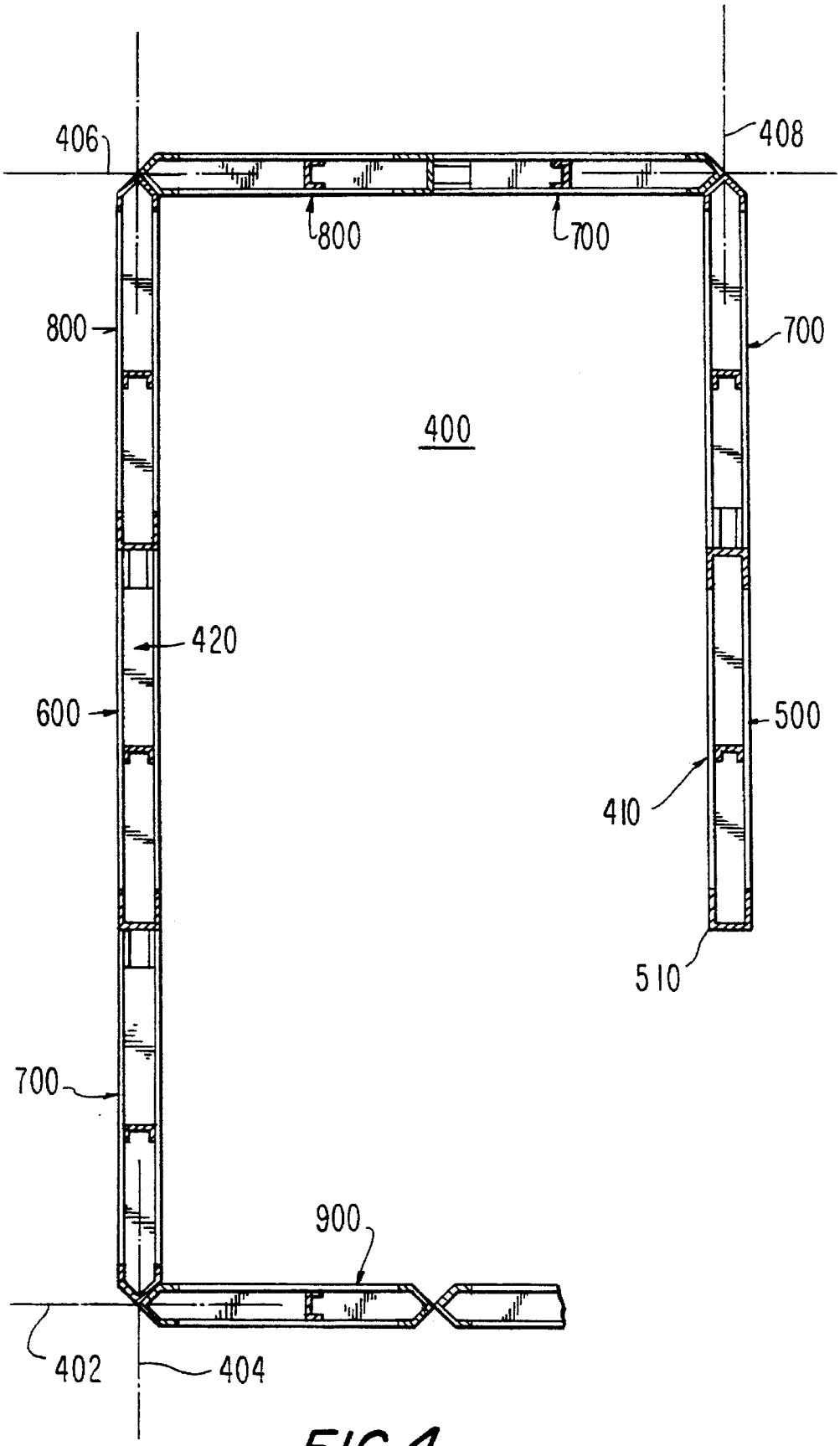
FIG. 4 is a schematic plan view, in cross-section, of an illustrative configuration formed with the structural panels of the present invention.
Figure 5:
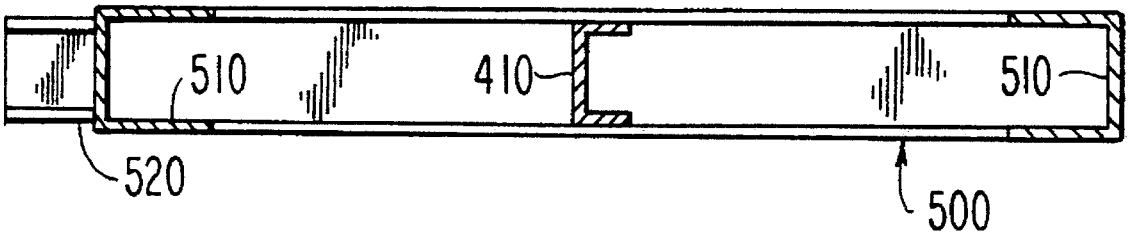
FIG. 5 is a transverse cross-sectional view of an end panel having a connecting stud along one vertical edge.
Figure 17:
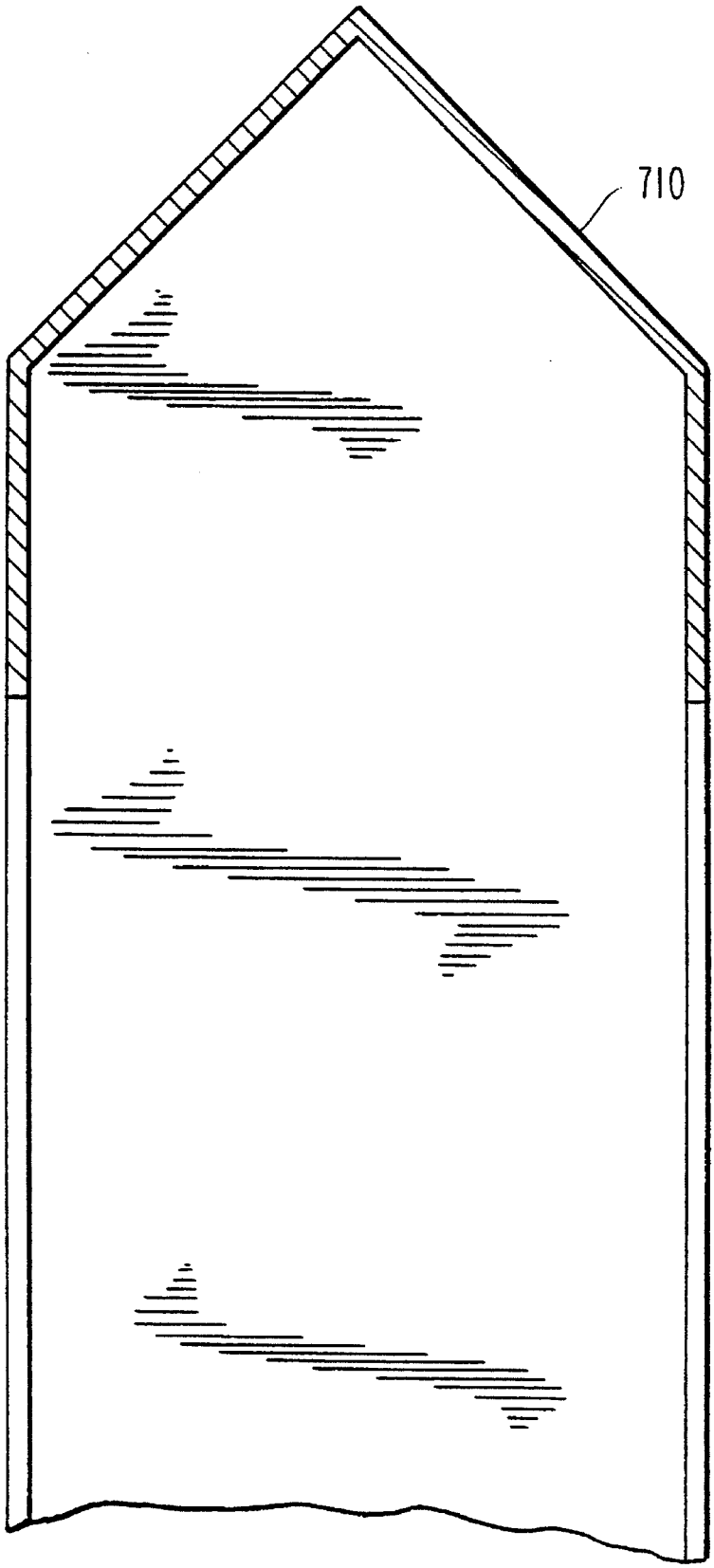
FIG. 17 is a cross-sectional view of the "V" shaped stud shown in the panels of FIGS. 7–9 and used in a generally perpendicular intersection of panels.
Figure 18:
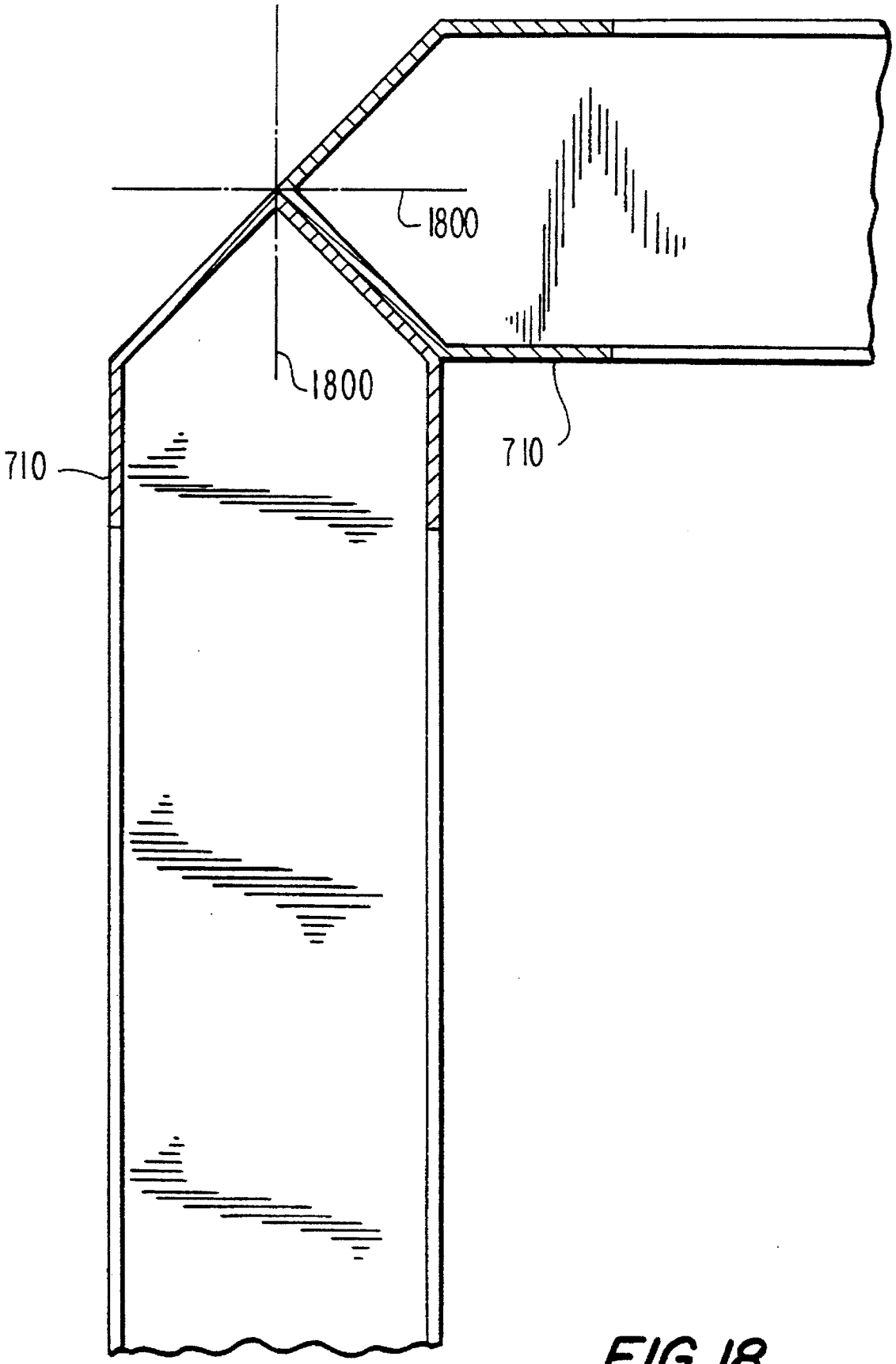
FIG. 18 is a cross-sectional view of two panels with "V" shaped studs forming an "V" shaped connection, e.g., a corner of a building.
Figure 19:
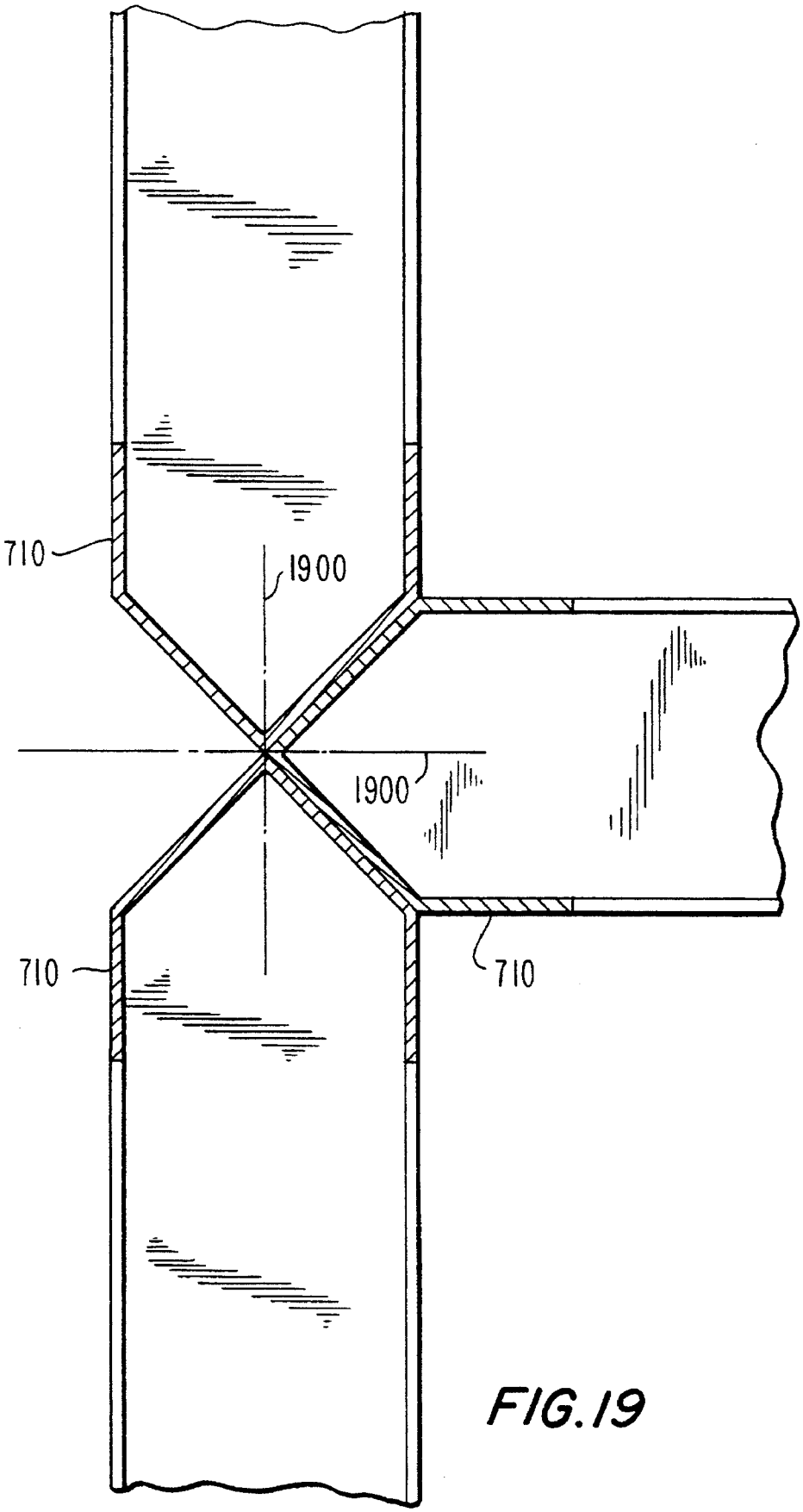
FIG. 19 is a cross-sectional view of three panels with "V" shaped studs forming a "⊢" shaped connection, e.g., a panel perpendicularly connected in the middle of a straight wall configuration.
Figure 20:
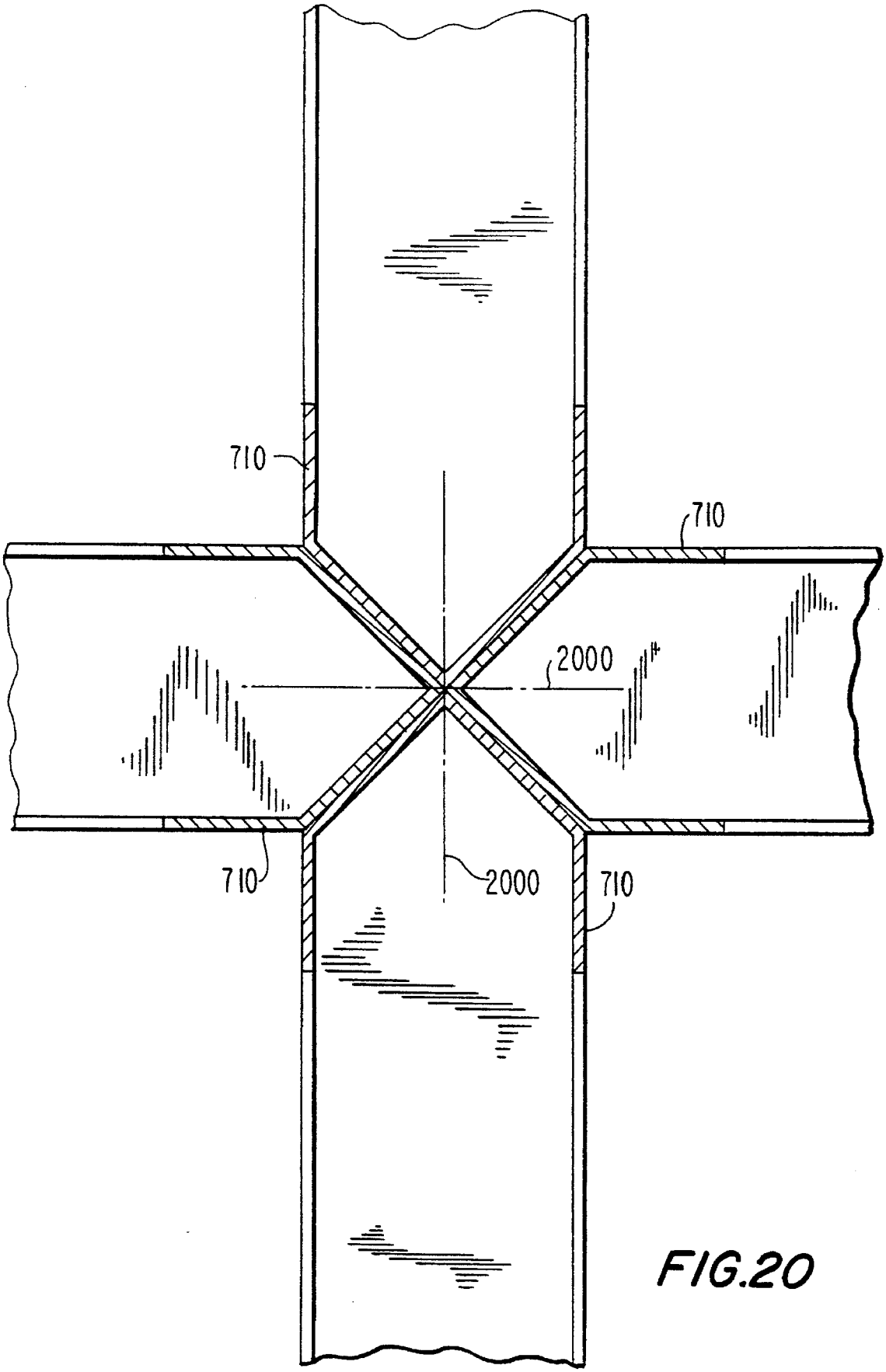
FIG. 20 is a cross-sectional view of a four panel "+" shaped intersection, i.e., the intersection of two straight wall configurations.

Construction system 400 of the present invention is shown in FIGS. 4–21. As can be easily seen, unlike the panels of system 100, the ends of panels 500, 600, 700, 800, and 900 are aligned and meet along their central alignment planes 402, 404, 406, and 408. Furthermore, panels 500, 600, 700, 800, and 900 (shown individually in FIGS. 5–9, respectively) are easily interconnected by direct attachment along their vertical edges with either male connection elements 520 (shown in more detail in FIGS. 5, 6 and 10–16) or "⋁" shaped studs 710 (shown in more detail in FIG. 17). Typically, the panels are welded, screwed, or otherwise directly fastened to one another, thereby reducing costs and construction time. The continuous alignment of the panels, throughout the different floor levels, and the successive interconnection of the panels, will create a uniform structural skeleton as shown in FIGS. 4 and 21.

Construction system 400 can be used to erect exterior or interior walls, for any habitable structure, using any of five basic types of panels 500, 600, 700, 800, and 900. The structural design of each panel is defined by three or four elements or studs about the perimeter of the panel (see FIG. 21), adjacent studs joined at an angle A of preferably 90° . The studs are preferably formed from galvanized metal, stainless steel, injected plastic, aluminum, or any other material with the structural capacity and strength required for the construction of a habitable structure, and shaped to create the specific desired cross-section. When necessary, one or more stiffener elements 410 (depending on the length of the panel) of any desired configuration may be used. Each stiffener element 410 is preferably aligned vertically within the panel between the upper and lower studs, and preferably generally perpendicular to at least the lower stud.

Figure 10:
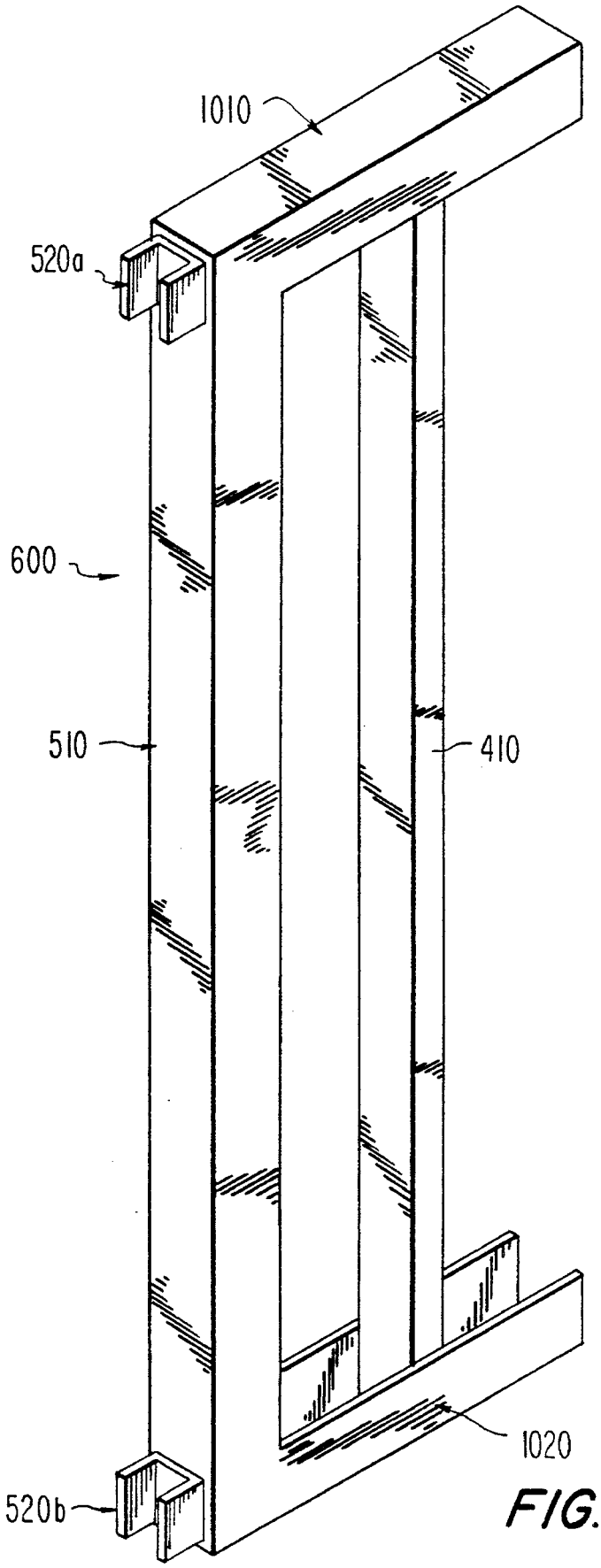
FIG. 10 is an isometric view of the panel of FIG. 6.
Figure 21:
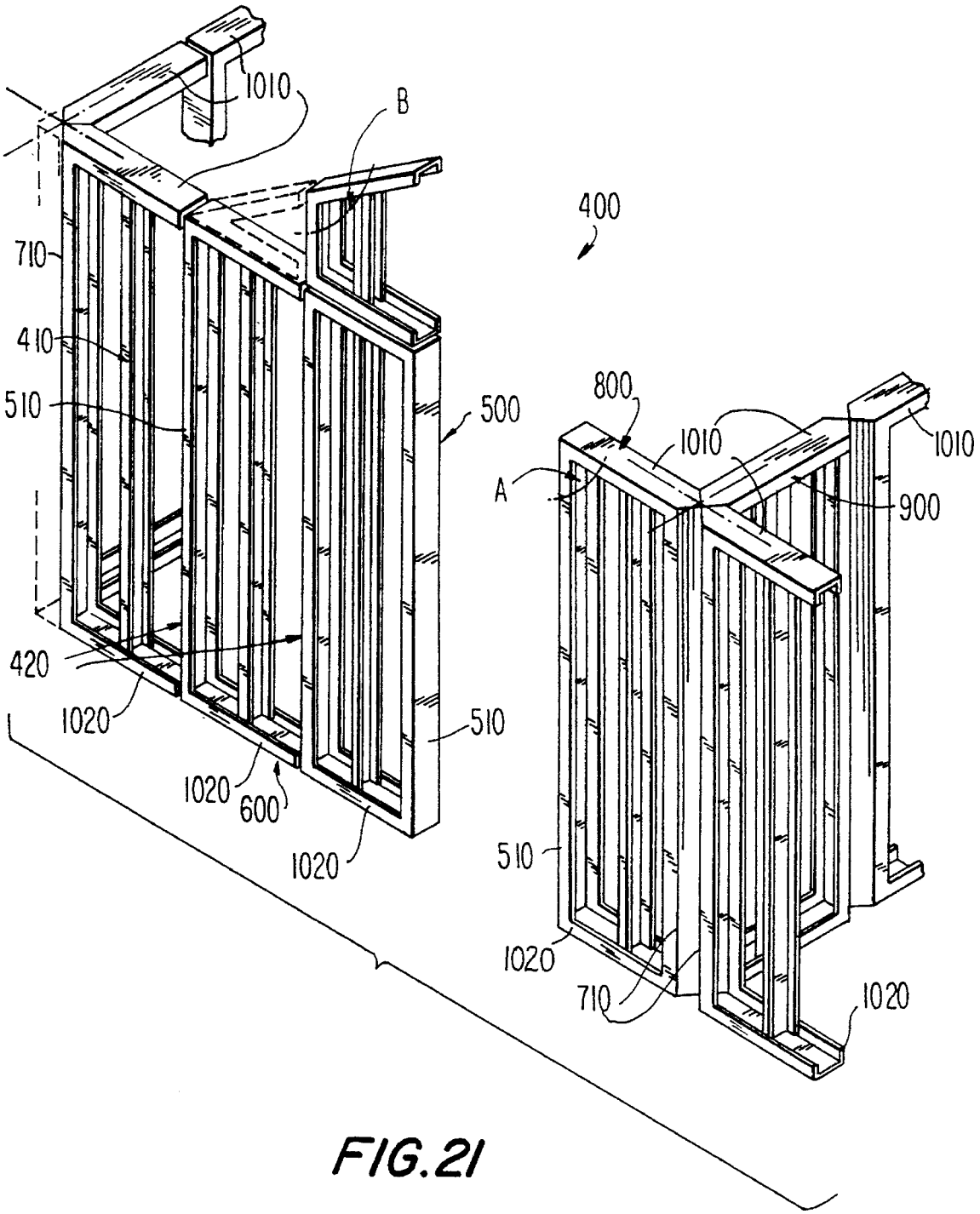
FIG. 21 is an isometric view of interconnected panels of the present invention forming a regular structural building skeleton in accordance with the principles of this invention.

All of the five panels 500, 600, 700, 800, and 900 have in common with one other at least two sides—upper stud 1010 and lower stud 1020, shown in FIGS. 10 and 21. Upper stud 1010 and lower stud 1020 are preferably "⊏" shaped, having two parallel sides joined, perpendicularly, along juxtaposed free ends with a third side, and are generally horizontally positioned, parallel to each other. At least one vertical stud 510 or 710 (see FIG. 21) connects upper and lower studs 1010 and 1020. As seen, for example, in FIGS. 8 and 21, vertical stud 510 has a generally "⊏" shaped cross-section (similar to upper and lower studs 1010 and 1020), whereas vertical stud 710 has a generally "⋁" shaped cross-section, having two parallel sides joined along their juxtaposed free ends by two converging sides forming a vertex directed away from the parallel sides. The choice of which and how many vertical studs are to be used in the formation of a panel depends on the function and ultimate location of the panel within the system, as will be described in greater detail below.

The shape of the vertical stud determines its function. Vertical studs 510 having a "⊔" shaped cross-section with a flat vertical base, are typically used at the end of a panel to finish the vertical edge of a panel, as shown in FIGS. 4, 5, 8, and 21. Panels with a "⊔" shaped vertical stud 510 allow for a unidirectional interconnection, i.e, such panels can only be interconnected with one other panel along the opposite vertical edge. However, with the addition of a male connection element 520 on the flat base of "⊔" shaped studs 510, as shown in FIGS. 5, 6, and 10–16, panels with "⊔" shaped studs 510 may be interconnected along those studs to form a substantially straight wall configuration. Panels having "⋁" shaped studs 710, such as shown in FIGS. 7–9 and 17 are typically used for perpendicular intersections or corners, as shown in FIGS. 18–21.

Figure 11:
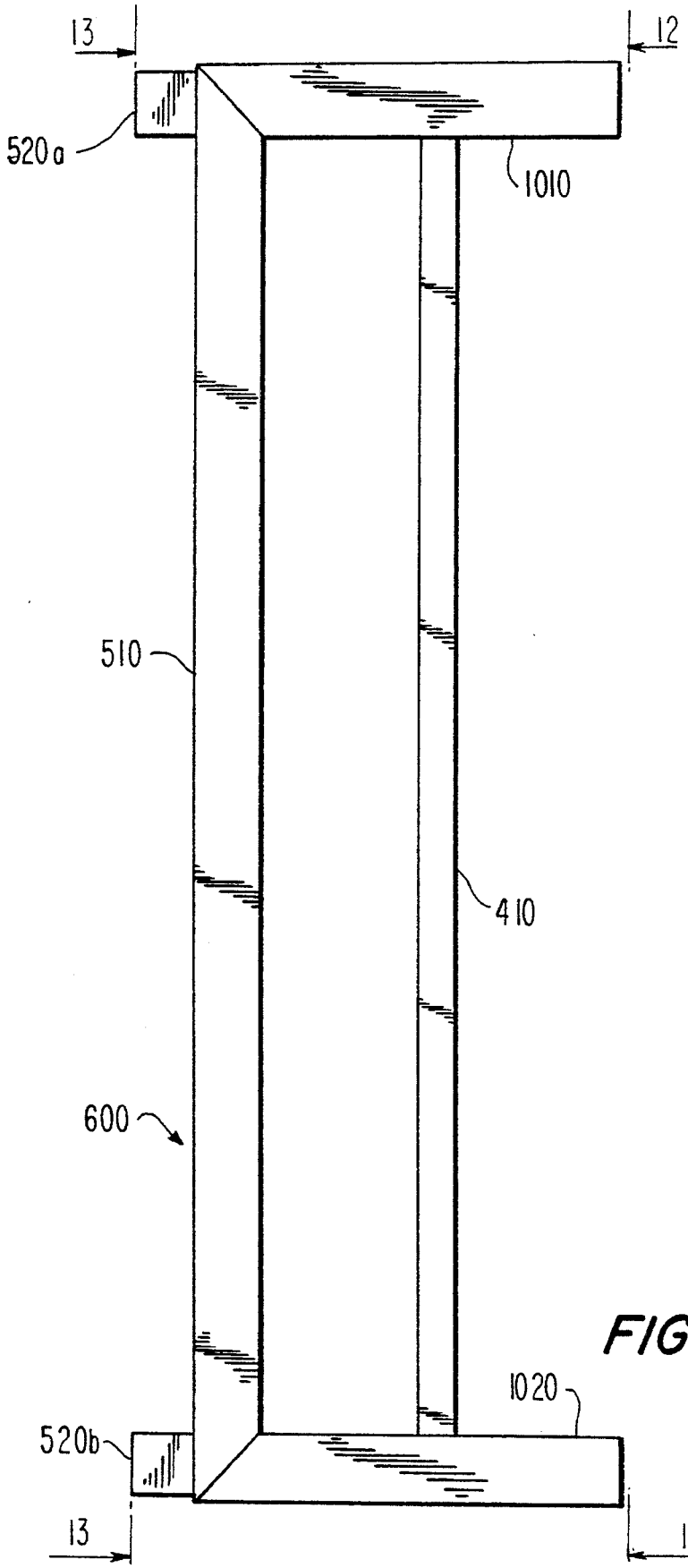
FIG. 11 is a plan view of the panel of FIG. 6.

Preferably two male connection elements 520*a* and 520*b* are used on "⊔" shaped stud 510. A preferred design for male connection elements 520*a* and 520*b* is shown in FIGS. 10, 11, and 13 and in enlarged isolation in FIGS. 14–16. As most easily seen in FIGS. 10 and 14, male connection elements 520*a* and 520*b* preferably has a "⊔" shaped cross-section, similar to that of upper and lower studs 1010 and 1020. However, the distance between the parallel sides of male connection element 520 is preferably smaller than the distance between the parallel sides of upper and lower studs 1010 and 1020 so that male connection element 520 can fit into studs 1010 and 1020. The respective distances may be compared upon viewing FIGS. 12 and 13. It will be understood that male connection element 520 can have any other desired configuration which preferably will fit into an adjoining panel to allow for proper interconnection.

When upper stud 1010 and lower stud 1020 of a panel are joined at first juxtaposed ends with a stud 510, and at second juxtaposed ends with a stud 510 having male connection elements 520, the result is panel 500, shown in FIGS. 4, 5, and 10–13. If male connection elements 520 are used on only one of the vertical studs 510, then panel 500 may be used as a finishing or terminal panel, as shown in FIG. 4. However, if both "⊔" shaped studs 510 have male connection elements 520, then panel 500 can be joined between panels to form a substantially straight wall configuration.

Figure 6:
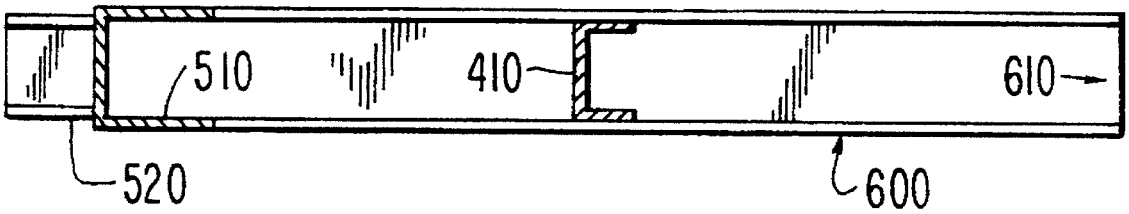
FIG. 6 is a transverse cross-sectional view of a panel which may be used between two other panels in a straight wall configuration.

If only one vertical stud 510 with male connection elements 520 is used, and the other vertical edge does not have a stud, then panel 600 of FIGS. 4 and 6 is formed. Panel 600 is capable of bidirectional interconnections and can be joined between two panels to form a substantially straight wall configuration.

Figure 7:
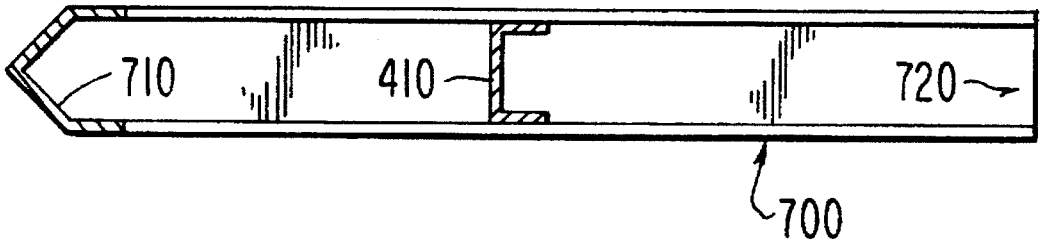
FIG. 7 is a transverse cross-sectional view of a panel which may be joined perpendicularly along a first vertical edge to a panel and joined in a straight wall configuration along the second vertical edge.
Figure 8:
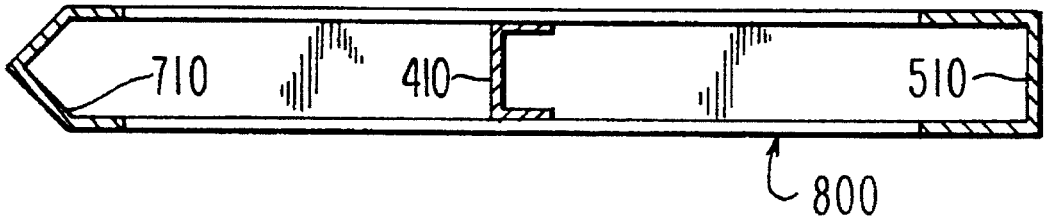
FIG. 8 is a transverse cross-sectional view of an end panel which may be joined perpendicularly along one vertical edge.
Figure 9:
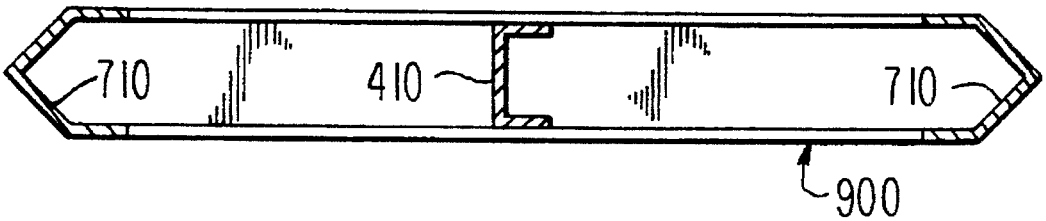
FIG. 9 is a transverse cross-sectional view of a panel which is configured to be joined perpendicularly along both vertical edges to another panel.

Panels 700, 800, and 900 of FIGS. 7, 8, and 9, respectively, include at least one "V" shaped vertical stud 710. Panel 700 is similar to panel 600 in that only one vertical stud is used. The other vertical edge does not have a stud and receives male connection members 520 to form a straight wall configuration along that vertical side. The side with " V " shaped vertical stud 710 typically is used to form a perpendicular connection with a similar "V" shaped vertical stud 710, as shown in FIGS. 4 and 18–21.

Panel 800 is similar to panel 500 in that a "⊔" shaped vertical stud 510 is used on one side such that panel 800 may be used as a finishing panel. However, if desired, male connection elements 520 having a configuration similar to those shown in FIGS. 10–13 may be included along stud 510, as shown in FIG. 4. That vertical edge may then be joined to the vertical edge of another panel to form a straight wall configuration at that end of panel 800. The vertical edge having "V" shaped stud 710 typically is interconnected perpendicularly to another panel along a similarly configured stud.

Panel 900, shown in FIG. 9, has a "V" shaped vertical stud at each vertical edge and may be used for bidirectional intersections with panel edges having similarly configured studs. Interconnection of panels 900 are shown in FIGS. 4 and 21.

As understood from the above description and the Figures, construction system 400 includes five basic panel types wherein the location and alignment of the panels permits construction of any type of wall required for the project, without requiring the design or construction of specific additional panels. The configuration, function, joining, and intersection of each of the panels of construction system 400 can be adapted for any type of architectural design. Even atypical areas or irregular forms in the vertical planes can be constructed, such as the formation of angles B other than 90° (angle A) between studs, as shown in FIG. 21.

Because of the unique connection of the free ends of the panels of construction system 400, the central alignment planes of all of the panels are aligned and joined along the vertical edges of the panels. Such alignment is easily observed between panels interconnected with male connection members 520. As shown in FIGS. 4 and 18–21, the central alignment planes of panels joined along "V" shaped studs 710 are also joined and aligned. In particular, in FIG. 18, central alignment planes 1800 of two panels joined along "V" shaped studs 710 to form a "⌐" intersection are automatically joined and aligned upon interconnection. Likewise, in FIG. 19, central alignment planes 1900 of three panels joined along "V" shaped studs 710 to form a "⊢" intersection are automatically joined and aligned upon interconnection. The same is true for central alignment planes 2000 of four studs 710 joined to form a "+" intersection in FIG. 20. Thus, in all of the edifices designed and constructed using the panels of construction system 400, alignment of the panels' central alignment planes will be maintained creating a geometric order in the whole structure which simplifies and regularizes the specific dimensioning in the assembly process, on site. Moreover, the strong one-piece structural panel and its design allows the panels to be used to construct multi-level buildings.

The structural design of the panels of construction system 400 also provides an air cavity 420 between the perimeter studs of the panels' frame. Air cavity 420 permits, when necessary, the installation of any desired insulation material, such as thermal or acoustic insulation, or the air itself can serve as insulation. This option is important because it allows the panels to be adapted to the specific climate condition and budget of the building project. It also provides flexibility with respect to the location of electrical, mechanical, and sanitary installations within the panels, and placement of pipes/tubes and other required vertical elements. The panels are therefore adaptable to a number of internal fixtures and any construction situation, without the need for additional elements, panels, systems, or other different forms of construction.

It will understood that the foregoing is merely illustrative of the principles of the invention, and that various modifications can be made by those skilled in the art without departing from the scope and spirit of the invention. For example, the dimensions, materials, and calibers used in the panels of the present invention, the specific configuration and design of the male connection elements, and the stiffeners may be modified as desired without changing the basic principles of the invention. The described embodiments are presented for the purpose of illustration rather than limitation, and the present invention is limited only by the claims which follow.

What is claimed is:

1. A panel for a prefabricated construction system, said panel comprising:

an upper stud having a first end and a second end;

a lower stud having a first end juxtaposed with said first end of said upper stud and second end juxtaposed with said second end of said upper stud; and a first vertical stud dimensioned and shaped to be directly interconnected with at least one of upper and lower studs of another of said panels, said first vertical stud joining said first juxtaposed ends of said upper and lower studs for preventing relative movement between said panels in at least two directions and providing load bearing capacity for said panels.

2. The panel of claim 1 further including a stiffener element positioned among said upper, lower, and first vertical studs.

3. The panel of claim 1 wherein said first vertical stud has two parallel sides having a pair of juxtaposed free ends and two converging sides joining said juxtaposed free ends and forming a vertex directed away from said parallel sides.

4. The panel of claim 1 wherein said first vertical stud has two parallel sides having a pair of juxtaposed free ends and a perpendicular side joining said juxtaposed free ends and perpendicular to said two parallel sides.

5. The panel of claim 4 wherein said first vertical stud has at least one male connection element positioned on said perpendicular side, facing away from said parallel sides.

6. The panel of claim 5 wherein said at least one male connection element comprises two male connection elements, one male connection element being positioned adjacent said upper stud and one male connection element being positioned adjacent said lower stud.

7. The panel of claim 5 wherein:

said at least one male connection element comprises first and second parallel sides;

said first and second parallel sides of said at least one male connection element are spaced apart a first distance;

said upper and lower studs each comprise two parallel sides having a pair of juxtaposed free ends and a perpendicular side joining said juxtaposed free ends and perpendicular to said two parallel sides; and said two parallel sides of each of said upper and lower studs are spaced apart a second distance greater than said first distance, whereby said first and second sides of said male connection element fit tightly between said first and second sides of said upper and lower studs.

8. The panel of claim 1 further comprising a second vertical stud joining said second juxtaposed ends of said upper and lower studs.

9. The panel of claim 8 wherein one of said first and second vertical studs comprises a "V" shaped stud, said two parallel sides being joined along said juxtaposed free ends by two converging sides forming a vertex, the vertex pointing away from said upper and lower studs.

10. The panel of claim 9 wherein the other of said first and second vertical studs comprises a "V" shaped stud, the vertex pointing away from said upper and lower studs.

11. The panel of claim 9 wherein the other of said first and second vertical studs comprises a "⊔" shaped stud.

12. The panel of claim 11 wherein said "⊔" shaped stud has at least one male connection element.

13. The panel of claim 8 wherein said first and second studs are "⊔" shaped.

14. The panel of claim 13 wherein at least one of said first and second "⊔" shaped studs has at least one male connection element.

15. The panel of claim 1 wherein said upper and lower studs each comprise two parallel sides having a pair of juxtaposed free ends and a perpendicular side joining said juxtaposed free ends and perpendicular to said two parallel sides.

16. The panel of claim 1 wherein said upper, lower, and vertical studs define edges of a hollow space within said panel.

17. A stud for a wall panel comprising:

first and second parallel sides spaced apart a first distance, each side having a pair of juxtaposed free ends; and means for connecting said pair of juxtaposed free ends of said first and second parallel sides, said connecting means comprising two converging sides ending at a vertex pointed away from said first and second parallel sides, said connecting means forming a "v", said stud thereby forming a "V" shape.

18. A stud for a wall panel comprising:

first and second parallel sides spaced apart a first distance, each side having a pair of juxtaposed free ends; and means for connecting said pair of juxtaposed free ends of said first and second parallel sides, said connecting means comprising a third side perpendicular to and joining said first and second parallel sides and at least one male connection element positioned on said third side and extending away from said first and second parallel sides, said male connection element dimensioned and shaped to be directly interconnected with another said stud.

19. The stud of claim 18 wherein:

said male connection element comprises first and second parallel sides;

said first and second parallel sides of said at least one male connection element are spaced apart a first distance;

said first and second parallel sides of said stud are spaced apart a second distance greater than said first distance, such that said first and second sides of said male connection element can fit tightly between first and second sides of a similarly configured stud.

20. A prefabricated building system comprising:

a plurality of types of structural panels, each said panel comprising:

an upper stud having a first end and a second end;

a lower stud having a first end juxtaposed with said first end of said upper stud and a second end juxtaposed with said second end of said upper stud; and at least one vertical stud joining one of said first and second juxtaposed ends of said upper and lower studs; wherein:

each said stud has two parallel sides;

each said panel has a central alignment plane; and each said panel is directly interconnected with another panel in said system at a point of interconnection of said panels along one of said juxtaposed ends of said upper and lower studs such that said central alignment planes of said interconnected panels meet at said point of interconnection of said panels.

21. The construction system of claim 20 wherein:

a first of said plurality of panel types has only one vertical stud;

said one vertical stud comprises two parallel sides having a pair of juxtaposed free ends and a perpendicular side joining said juxtaposed free ends and perpendicular to said two parallel sides; and the other of said first and second juxtaposed ends are free to be interconnected with studs of another panel.

22. The construction system of claim 21 wherein said vertical stud further includes at least one male connection element positioned on said perpendicular side, facing away from said parallel sides.

23. The construction system of claim 20 wherein:

a second of said plurality of panel types has first and second vertical studs;

said first vertical stud joins said first juxtaposed ends;

said second vertical stud joins said second juxtaposed ends; and said first and second vertical studs each comprise two parallel sides having a pair of juxtaposed free ends and a perpendicular side joining said juxtaposed free ends and perpendicular to said two parallel sides.

24. The construction system of claim 23 wherein only said first vertical stud further includes at least one male connection element positioned on said perpendicular side, facing away from said parallel sides.

25. The construction system of claim 23 wherein both said first and second vertical studs further include at least one male connection element positioned on said perpendicular side, facing away from said parallel sides.

26. The construction system of claim 20 wherein:

a third of said plurality of panel types has only one vertical stud;

said vertical stud comprises two parallel sides having a pair of juxtaposed free ends and two converging sides joining said juxtaposed free ends and forming a vertex directed away from said parallel sides; and the other of said first and second juxtaposed ends are free to be interconnected with studs of another panel.

27. The construction system of claim 20 wherein:

a fourth of said plurality of panel types has first and second vertical studs;

said first vertical stud joins said first juxtaposed ends;

said second vertical stud joins said second juxtaposed ends; and said first and second vertical studs each comprise two parallel sides having a pair of juxtaposed free ends and two converging sides joining said juxtaposed free ends and forming a vertex directed away from said parallel sides.

28. The construction system of claim 20 wherein:

a fifth of said plurality of panel types has first and second vertical studs;

said first vertical stud joins said first juxtaposed ends;

said second vertical stud joins said second juxtaposed ends; and said first vertical stud comprises two parallel sides having a pair of juxtaposed free ends and a perpendicular side joining said juxtaposed free ends and perpendicular to said two parallel sides;

said second vertical stud comprises two parallel sides having a pair of juxtaposed free ends and two converging sides joining said juxtaposed free ends and forming a vertex directed away from said parallel sides.

29. The construction system of claim 21 wherein said first vertical stud further includes at least one male connection element positioned on said perpendicular side, facing away from said parallel sides.

30. The stud of claim 17 wherein said first and second parallel sides define edges of a hollow space within said stud.

31. The stud of claim 18 wherein said first and second parallel sides define edges of a hollow space within said stud.

32. The building system of claim 20 wherein said upper stud, said lower stud and said at least one vertical stud define edges of a hollow space within said panel.

33. A stud for a wall panel comprising:

a first side having a first end and a second end;

a second side having a first end spaced apart a first distance from said first end of said first side and a second end spaced apart a second distance from said second end of said first side; and means for connecting said first ends of said first side and said second side, said connecting means comprising a third side joining said first and second sides at said first end of said first side and said first end of said second side, said connecting means dimensioned and shaded to be directly interconnected with at least one other said stud for preventing relative movement in at least two directions between said studs and providing load bearing capacity for said studs.

34. The stud of claim 33 wherein said connecting means further comprises at least one male connection element positioned on said third side and extending away from said first and second sides.

35. The stud of claim 33 further comprising a stiffener element positioned among said first, second and third sides.

36. The stud of claim 33 wherein said first, second and third sides define edges of a hollow space within said stud.

37. The panel of claim 16 wherein said hollow space is filled with an insulative material.

38. The stud of claim 30 wherein said hollow space is filled with an insulative material.

39. The stud of claim 31 wherein said hollow space is filled with an insulative material.

40. The building system of claim 32 wherein said hollow space is filled with an insulative material.

41. The stud of claim 36 wherein said hollow space is filled with an insulative material.

42. The construction system of claim 20 further comprising a stiffener element positioned among said upper, lower and at least one vertical studs.

43. The stud of claim 33 wherein said first distance is different from said second distance.

44. The stud of claim 33, said stud being adapted to be positively fastened to another said stud after said studs have been interconnected.

45. A prefabricated building system comprising:

a plurality of types of structural panels, each said panel comprising:

an upper stud having a first end and a second end;

a lower stud having a first end juxtaposed with said first end of said upper stud and a second end juxtaposed with said second end of said upper stud; and at least one vertical stud dimensioned and shaped to be directly interconnected with at least one of upper and lower studs of another of said panels, said first vertical stud joining said first juxtaposed ends of said upper and lower studs; wherein:

each said panel is directly interconnected with another panel in said system.

46. The building system of claim 45 further comprising a stiffener element positioned among said upper, lower and at least one vertical studs.

47. The building system of claim 45 wherein each of said studs has two parallel sides.

48. The building system of claim 47 wherein:

a first of said plurality of panel types has only one vertical stud;

said one vertical stud comprises two parallel sides having a pair of juxtaposed free ends and a perpendicular side joining said juxtaposed free ends and perpendicular to said two parallel sides; and the other of said first and second juxtaposed ends are free to be interconnected with studs of another panel.

49. The building system of claim 48 wherein said vertical stud further includes at least one male connection element positioned on said perpendicular side, facing away from said parallel sides.

50. The building system of claim 48 wherein said first vertical stud further includes at least one male connection element positioned on said perpendicular side, facing away from said parallel sides.

51. The building system of claim 47 wherein:

a second of said plurality of panel types has first and second vertical studs;

said first vertical stud joins said first juxtaposed ends;

said second vertical stud joins said second juxtaposed ends; and each of said first and second vertical studs comprises two parallel sides having a pair of juxtaposed free ends and a perpendicular side joining said juxtaposed free ends and perpendicular to said two parallel sides.

52. The building system of claim 51 wherein only said first vertical stud further includes at least one male connection element positioned on said perpendicular side, facing away from said parallel sides.

53. The building system of claim 51 wherein each of said first and second vertical studs further includes at least one male connection element positioned on said perpendicular side, facing away from said parallel sides.

54. The building system of claim 47 wherein:

a third of said plurality of panel types has only one vertical stud;

said vertical stud comprises two parallel sides having a pair of juxtaposed free ends and two converging sides joining said juxtaposed free ends and forming a vertex directed away from said parallel sides; and the other of said first and second juxtaposed ends are free to be interconnected with studs of another panel.

55. The building system of claim 47 wherein:

a fourth of said plurality of panel types has first and second vertical studs;

said first vertical stud joins said first juxtaposed ends;

said second vertical stud joins said second juxtaposed free ends; and said first and second vertical studs each comprise two parallel sides having a pair of juxtaposed free ends and two converging sides Joining said juxtaposed free ends and forming a vertex directed away from said parallel sides.

56. The building system of claim 47 wherein:

a fifth of said plurality of panel types has first and second vertical studs;

said first vertical stud joins said first juxtaposed ends;

said second vertical stud joins said second juxtaposed free ends; and said first vertical stud comprises two parallel sides having a pair of juxtaposed free ends and a perpendicular side Joining said juxtaposed free ends and perpendicular to said two parallel sides;

said second vertical stud comprises two parallel sides having a pair of juxtaposed free ends and two converging sides joining said juxtaposed free ends and forming a vertex directed away from said parallel sides.

57. The building system of claim 45 further comprising fasteners for positively fastening said panels to each other after said panels have been interconnected.

58. The panel of claim 1, said panel being adapted to be positively fastened to another said panel after said panels have been interconnected.

59. The stud of claim 17, said stud being adapted to be positively fastened to another said stud after said studs have been interconnected.

60. The stud of claim 18, said stud being adapted to be positively fastened to another said stud after said studs have been interconnected.

61. The building system of claim 20 further comprising fasteners for positively fastening said panels to each other after said panels have been interconnected.

62. A panel for a prefabricated construction system, said panel comprising:

at least one horizontal stud having two free ends; and a vertical stud dimensioned and shaped to be directly interconnected with at least one of said vertical and said at least one horizontal stud of another of said panels, said first vertical stud adjoining one of said free ends of said at least one horizontal stud for preventing relative movement between said panels in at least two directions and providing load bearing capacity for said panels.

63. The panel of claim 62 further including a stiffener element positioned among said at least one horizontal and vertical studs.

64. The panel of claim 62, said vertical stud having at least one male connection element positioned adjacent to and facing away from said at least one horizontal stud.

* * * * *